United States Patent [19]

Miller

[11] Patent Number: 4,919,301

[45] Date of Patent: Apr. 24, 1990

[54] FLUID RESERVOIR STRUCTURE FOR A FLUID SYSTEM

[75] Inventor: Steven L. Miller, Shelby County, Ky.

[73] Assignee: Environmental Water Technology, Inc., Louisville, Ky.

[21] Appl. No.: 309,187

[22] Filed: Feb. 13, 1989

[51] Int. Cl.[5] ..... B65D 25/00

[52] U.S. Cl. ..... 220/85 S; 220/260; 220/200; 220/284

[58] Field of Search ..... 220/85 VR, 85 VS, 202, 220/855, 260, 200, 284

[56] References Cited

U.S. PATENT DOCUMENTS 4,090,525 5/1978 Potter ..... 220/85 VS
4,295,337 10/1981 Johnson et al. ..... 220/85 S
4,487,025 12/1984 Hamid ..... 220/85 VS
4,659,346 4/1987 Uranishi et al. ..... 220/85 VR
4,767,018 8/1988 Saito ..... 220/85 S
4,806,032 2/1989 Graey et al. ..... 220/85 VS

*Primary Examiner*—Joseph Man-fu Moy
*Attorney, Agent, or Firm*—Polster, Polster & Lucchesi

[57] ABSTRACT

Fluid reservoir structure for supplying treating fluid to be circulated through a fluid system having a fluid pump and quick disconnect fittings associated therewith including a fluid receptacle with quick disconnect fittings adapted to engage with the quick disconnect fittings in the fluid system, the fittings on the fluid receptacle being actuable from a remote location to engage with the fittings in the fluid system during a fluid circulating mode.

26 Claims, 6 Drawing Sheets

FLUID RESERVOIR STRUCTURE FOR A FLUID SYSTEM

BACKGROUND OF THE INVENTION

The present invention relates to fluid reservoir structure for a fluid system and more particularly to a readily portable fluid reservoir structure which can be efficiently connected to a fluid system to introduce stored fluid from a separate source into the fluid system for circulation therethrough.

Quick connect fittings to rapidly and efficiently connect one structural member to another have been long known in various structural arts wherein structural members have been placed in end-to-end relationship and joined together by such quick connect fittings, such arrangements being disclosed in U.S. Pat. No. 1,904,061, issued to S. Larson on Apr. 18, 1933, relating to a hose coupling, and U.S. Pat. No. 3,429,594, issued to R. L. Stedfeld on Feb. 25, 1969, relating to a quick disconnect coupling. In fact, in U.S. Pat. No. 4,784,771, issued to R. L. Wathen et. al. on Nov. 15, 1988, a fluid system is disclosed for purifying liquids, such as water, for medical endeavors, which fluid system incorporates quick connect fittings adapted to receive mating quick connect fittings on a fluid storage jug so that treating fluids stored in the jug can be included as part of a circulating mode for disinfection/rejuvenation of the fluid system. Although the fluid reservoir structure of the present invention is particularly useful in enhancing operations of such a fluid system as disclosed in U.S. Pat. No. 4,784,771, it is to be understood that the inventive fluid reservoir structure can also be used in a number of other environments to quickly and efficiently supply fluids to a system, for example, in supplying make-up fluids in machine tool lubricating and cooling systems and in supplying fluids to coolant systems in the heat exchange and air conditioning arts.

In accordance with the present invention, a straightforward, efficient and economical fluid reservoir structure is provided which requires a minimum of parts in manufacture, assembly, installation and operation. The manually portable structure of the present invention further avoids past requirements in many fluid systems for large, heat generating, fluid agitating, multi-stage centrifugal pumps, permitting instead the use of low residence volume, positive displacement pumps in association with the fluid system, the inventive fluid reservoir structure being readily and quickly installed by only one person with a minimum of training and with a minimum of operating steps, at the same time minimizing space requirements and past problems of seepage and undesirable bacteria formations. Further, the present invention provides a unique and novel structural arrangement which allows for maximum mechanical advantage during operations of the inventive fluid reservoir structure with a fluid system to overcome high initial static loads without requiring extensive space to do so. In addition, the present invention provides a unique and novel structural arrangement to control and maintain a stable fluid level in a fluid reservoir without undue fluid "hunting" or movement between preselected upper and lower levels. Various other features of the present invention will become obvious to one skilled in the art upon reading the disclosure set forth herein.

BRIEF SUMMARY OF THE INVENTION

More particularly, the present invention provides a fluid reservoir structure for supplying treating fluid to be circulated through a fluid system, the fluid system including mating quick connect fittings and having a fluid pump associated therewith to receive and circulate treating fluid from the inventive fluid reservoir structure through the fluid system and the fluid reservoir structure during a circulating mode comprising: fluid receptacle means adapted to receive and store treating fluid from a preselected supply source to be circulated through the fluid system and the fluid receptacle means when the fluid receptacle means is connected to the fluid system; spaced fluid inlet and outlet conduits mounted on a wall of the fluid receptacle means; adjustable quick connect fittings on the spaced fluid inlet and outlet conduits mounted on the fluid receptacle means to engage with the mating quick connect fittings in the fluid system during a fluid circulating mode; and, actuating means to remotely actuate the adjustable quick connect fittings on the spaced conduits to engage with the mating quick connect fittings of the fluid system during a fluid circulating mode. In addition, the present invention provides a novel fluid reservoir structure in the form of a portable fluid receptacle or bottle structure which incorporates an inclined ramp cooperable with a moveable lever and handle actuating mechanism, such actuating mechanism being positioned on the bottle at a location removed or remote from the quick connect fittings on the portable bottle. Further, the present invention includes novel dampening means to minimize fluid agitation within the bottle and novel fluid level control means operable both within and outside the bottle. Moreover, the present invention provides a novel structure for obtaining maximum mechanical advantage at commencement of the actuating stroke of the moveable lever to overcome the static and structural loading of the mechanism to be actuated and also a novel structure for arresting or holding the lever at the terminal portion of such actuating stroke.

It is to be understood that various changes can be made by one skilled in the art in one or more of the several structural parts of the apparatus disclosed without departing from the scope or spirit of the present invention. For example, the shape of the bottle and handle forming the fluid receptacle can be varied by one skilled in the art in accordance with design requirements, as can the type and location of quick connect fittings and the angle and location of the inclined camming structure, without departing from the scope or spirit of the present invention.

BRIEF DESCRIPTION OF THE DRAWINGS

Referring to the drawings which disclose an advantageous embodiment of the present invention and modified embodiments thereof particularly adapted for use with fluid systems having a comparatively greater fluid volume.

DETAILED DESCRIPTION OF THE DRAWINGS

Figure 1:
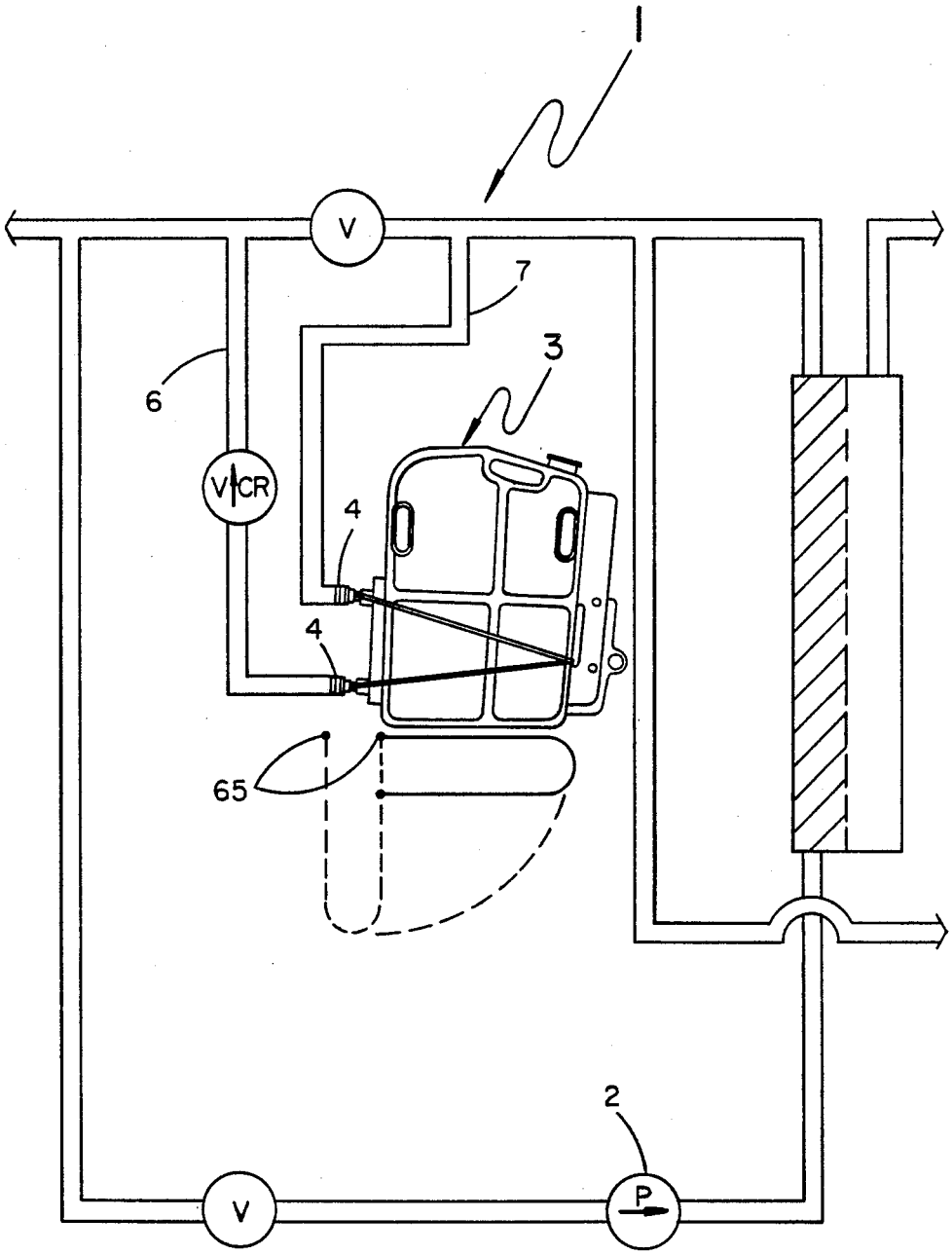
FIG. 1 schematically discloses a portion of a fluid system similar to that disclosed in above mentioned U.S. Pat. No. 4,784,771, including quick connect fittings and an associated pump, with the novel fluid reservoir structural embodiment of FIGS. 2–4 positioned adjacent thereto an joined therewith.

Referring to FIG. 1 of the drawings, the reference numeral 1 discloses the recirculating valve by-pass portion of a fluid system similar to that disclosed in U.S. Pat. No. 4,784,771, the fluid system having a pump 2 associated therewith. The inventive fluid reservoir structure is shown in the form of a fluid receptacle or bottle 3 with its quick connect fittings, broadly referred to by reference numeral 4 connected to mating quick connect fittings provided at the extremities of the spaced recirculating valve by-pass conduits 6 and 7.

Figure 2:
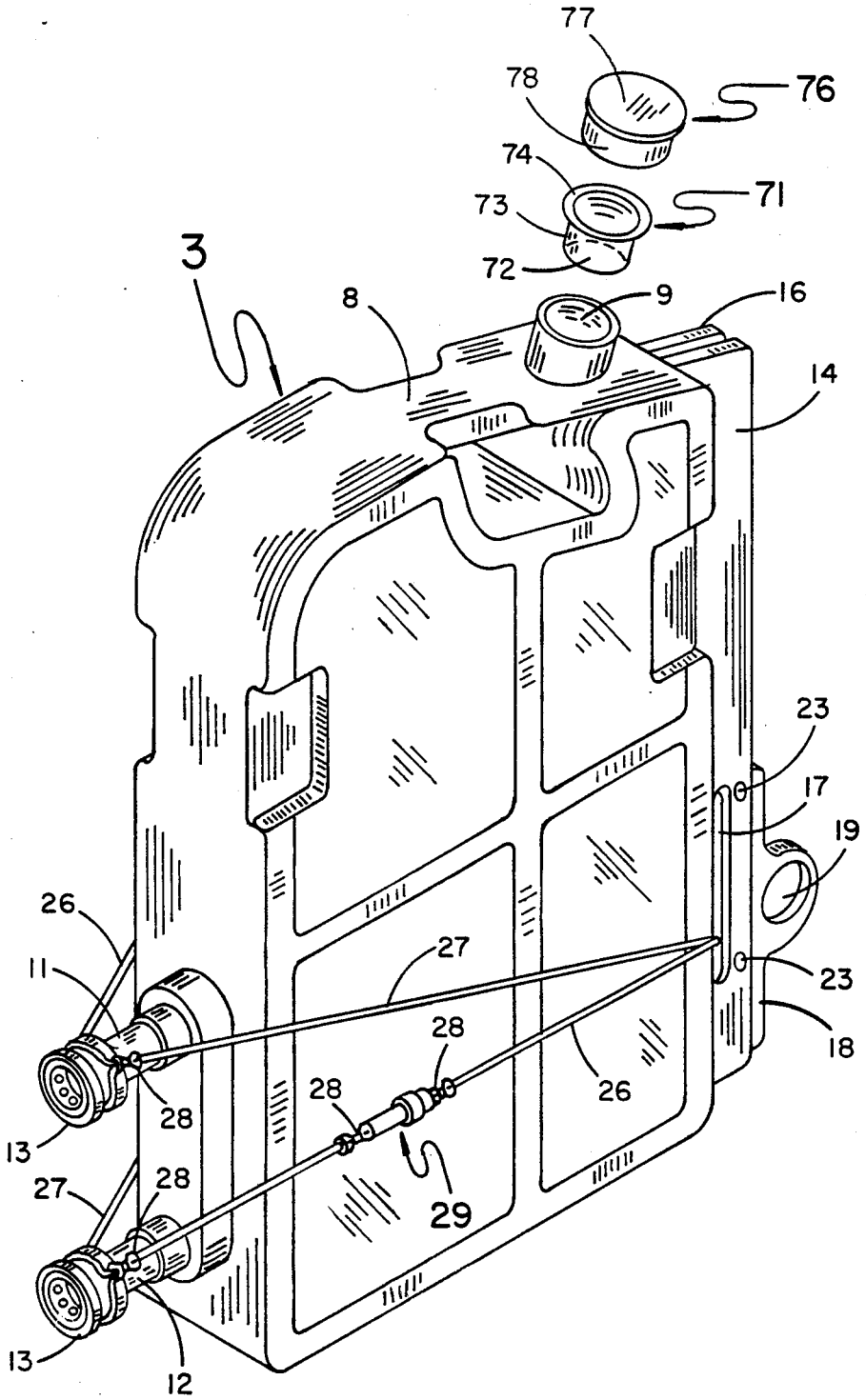
FIG. 2 is an enlarged isometric, partially exploded view of a first embodiment of a novel fluid reservoir in the form of a fluid receptacle or bottle particularly adapted for use with a fluid system having a comparatively small fluid volume, such first embodiment being disclosed in FIG. 1 of the drawings.
Figure 3:
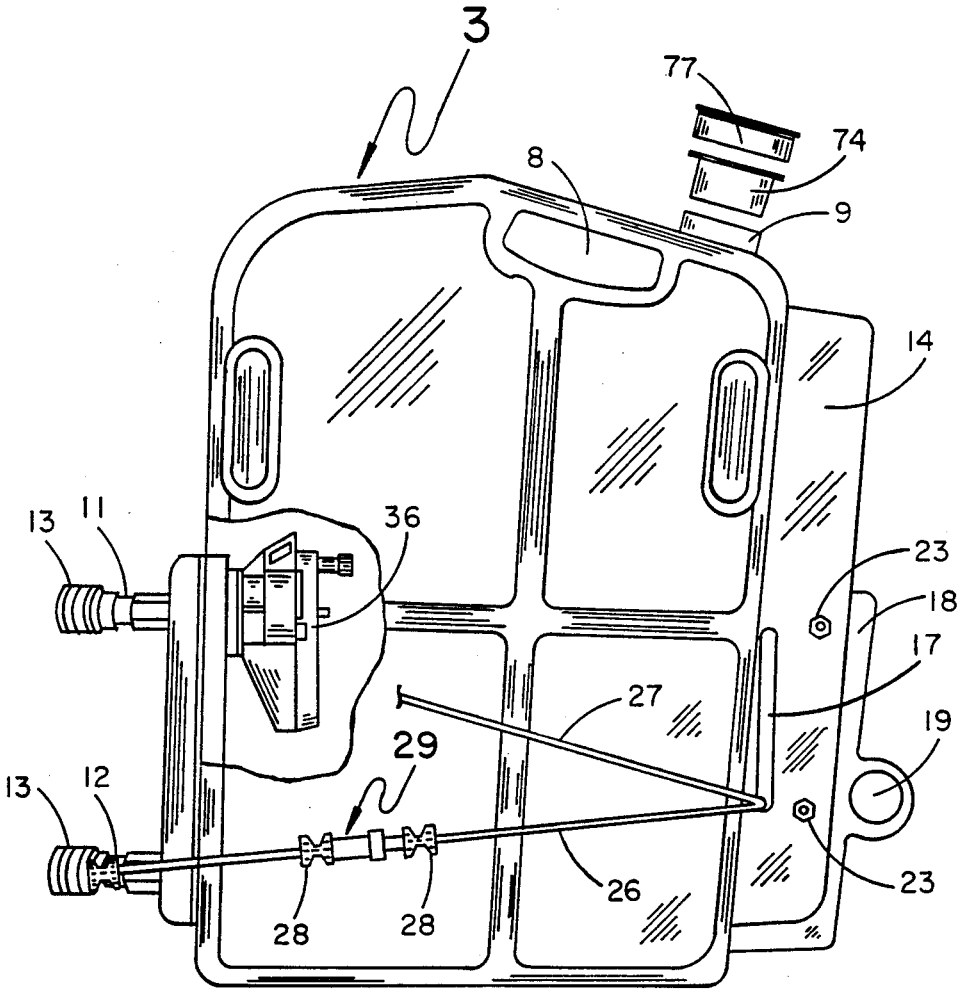
FIG. 3 is a side view of the fluid receptacle or bottle of FIG. 2, partially broken away to disclose one form of level sensing device which can be utilized with the present invention and here shown in association with the upper quick connect conduit assembly.
Figure 4:
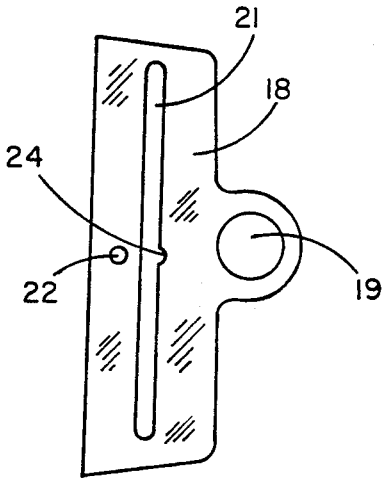
FIG. 4 is a side view of the moveable lever of FIGS. 2 and 3, which is shown in these earlier FIGS. 2 and 3 as slidable between spaced parallel rib members extending from the wall of the fluid receptacle opposite to that wall on which quick connect fittings are shown as mounted on spaced inlet and outlet conduits of the fluid receptacle.

Details of a first embodiment of the inventive fluid reservoir structure in the form of a fluid receptacle or bottle 3 can best be see in FIGS. 2–4 of the drawings. Fluid receptacle or bottle 3, which can be formed from any one of a number of suitable fluid handling materials such as a reinforced plastic, and which can be shaped in any one of a number of preselected geometric forms, is here shown as a four-sided narrow, rectangular type bottle including spaced wider side walls joined at opposed edge extremities by narrower spaced front and rear walls. The bottle 3, sized to hold approximately one gallon of fluid, further includes spaced top and bottom walls, the top wall being contoured to include a carrying handle 8 and an open inlet conduit 9 which serves to receive fluid from a preselected supply source to be stored in bottle 3 and subsequently circulated in an appropriate fluid system, such as above described fluid system 1. The front wall of fluid receptacle bottle 3 is provided with spaced upper and lower fluid conduits 11 and 12, respectively, which fluid conduits can be stainless steel with their respective center lines spaced approximately four (4) inches apart. In the first embodiment disclosed, upper fluid conduit 11 is arranged to serve as an inlet conduit and lower conduit 12 serves as an outlet conduit. Mounted on each of the spaced conduits at the outer extremity thereof is a quick connect fitting 13. The quick connect fitting 13 can be a part of any one of a number of commercially known fittings and, advantageously fitting 13 on each conduit 11 and 12 is the female or socket part of a two-way shut off socket and plug quick connect assembly, the plug or male portions of each assembly (not shown in detail herein) being connected to the extremities of the by-pass conduits 6 and 7 aforedescribed. Such socket and plug quick connect assembly can be a commercially available Hansen assembly obtainable from the Hansen Coupling Division, Cleveland, Ohio. This Hansen assembly includes spring actuated shut-off valves in both the socket and plug to provide immediate and positive shut-off of fluid on both the female and plug side of the matable fittings when disconnected and a positive seal between the matingly engaged fittings when connected. To connect the male and female parts of the coupling, a spring-loaded slidable collar on the female fitting 13 is pulled back and the male or plug portion (not shown) on a conduit extremity of the fluid system is matingly engaged with the socket, the spring-loaded collar is then released to lock the coupling into engagement. To disconnect the collar on female fitting 13 of a Hansen coupling, the collar is pulled back to unlock the coupling, permitting disengagement of the plug and socket, or male and female fittings, sealing both of the previously connected conduits, on which extremities the male and female fittings are respectively mounted, by means of the built-in shut-off valves in both fittings of a coupling assembly.

To accomplish this aforedescribed coupling quick connection manually at the fitting location while simultaneously supporting the fluid reservoir to be connected has been recognized by the present invention to be both manually difficult and cumbersome. The present invention, recognizing this problem, provides a unique space saving arrangement which provides for simultaneous remote collar actuation of the coupling fittings and simultaneous support and ready engagement of the fluid reservoir with the fluid system with which it is to be combined in overall fluid circulation.

As can be seen in FIGS. 2 and 3 of the drawings, such an actuating arrangement is disclosed to remotely and simultaneously actuate the adjustable quick connect fittings on the spaced conduits for engagement with the fittings of the fluid system to allow a fluid circulating mode. The arrangement in these figures includes a handle assembly having a moveable lever mounted at the rear or back wall of fluid receptacle or bottle 3 as a trigger mechanism with a linkage and caming arrangement connecting the moveable lever with the collars on the female or socket members 13 of the quick connect fittings on the inlet and outlet conduits of the fluid receptacle or bottle 3. In this regard, the handle assembly includes two spaced apart longitudinal rib members 14 and 16 which are fixed to and extend the length of the rear wall of the fluid receptacle or bottle 3. These rib members 14 and 16, which serve not only as part of the handle assembly but also as reinforcing struts, are provided with opposed longitudinally extending slots 17 extending upwardly and outwardly at a small angle of approximately 7-½ degrees from the vertical, slots 17 being positioned in the lower portions of the rib members to extend along the rib members adjacent to and along the rear wall of bottle 3 at a preselected location opposite and substantially intermediate the space between fluid upper and lower conduits 11 and 12 respectively on the opposed front wall of fluid receptacle or bottle 3. In other words, slots 17 extend between spaced horizontal planes determining the longitudinal axis of the spaced upper and lower conduits 11 and 12. It is to be noted in FIG. 3 that the parallel rear edges of the opposed side walls and thus the rear wall of bottle 3 slope outwardly in an upward direction at a preselected angle from the vertical, which can be advantageously approximately 15° so that the sloping rear side edges serve as a caming means for cable linkage described hereinafter. It is to be further noted that the upward and outwardly sloping rear wall of bottle 3 results in the upper portions of opposed slots 17 being closer to the sloping rear wall of bottle 3 than the lower portions of opposed slots 17. Arranged to be slidably disposed between spaced longitudinally extending rib members is a slidably moveable, longitudinally extending lever 18 (FIG. 4 of the drawings). One side longitudinal edge of lever 18 which serves as the inner edge when disposed between spaced rib members 14 and 16 slopes upwardly and outwardly from the rear wall of bottle 3 at an angle of approximately 15° from the vertical to allow this inner edge of the slidable lever to slidably conform with such upwardly and outwardly sloping rear wall of bottle 3. The opposite or outward side longitudinal edge of lever 18 is provided with finger grip hole 19. Moveable lever 18 is further provided with a vertically extending guide slot 21 and a cable passage 22 through which flexible looped cables, serving as linkage members and described hereinafter, are threaded. The vertically extending guide slot 21 is arranged to accommodate two spaced pins 23 fixed to and extending laterally between spaced rib members 14 and 16 so that guide slot 21 of lever 18 can be moved vertically along these pins. In this regard, it is to be noted that spaced pins 23 are positioned laterally in spaced relation from the upper and lower extremities of opposed slots 17 in opposed ribs 14 and 16. It also is to be noted that guide slot 21 is provided with an indention 24 to allow lever 18 to engage with and rest in held or stop position on the upper laterally disposed pin 23.

Again referring to FIGS. 2 and 3 of the drawings, the linkage means between vertically moveable lever 18 and the moveable collar on female fittings or sockets 13 is shown in the form of a pair of flexible, non-stretchable, cables 26 and 27 which can be made of a suitably strong, readily bendable or flexible material having a high resistance to change in shape and change in effective length or, in other words, a high modulus of elasticity. A suitable plastic, polyarimid material covered with a heat shrinkable, low friction Teflon tubing has been found to be advantageous for the purposes intended. Each cable 26 and 27 is strung in a unique manner to minimize change in effective length between the moveable collars on fittings 13 and moveable lever 18. In accordance with the present invention, it has been recognized that if one cable had its opposite ends connected to the same upper collar and the other cable had its opposite ends connected to the same lower collar with both cables looped around bottle 13 and connected to moveable lever 18, the change in the effective cable length with respect to a change in the vertical position of lever 18 would be greater with one of the spaced collars on fitting 13 being released and the collar on the other fitting 13 being retracted. The present invention not only recognizes this problem but resolves the same by looping in semicircular fashion around and fastening one end of cable 26 adjacent the collar of lower fitting 13, then passing the same cable 26 through the cable passage 22 and looping the other end of cable 26 in semicircular fashion around the collar of upper fitting 13, fastening such other end adjacent the collar of upper fitting 13. In similar fashion, cable 27 has one end looped in semicircular fashion around the collar of upper fitting 13 and fastened adjacent thereto the cable 27 then being passed through cable passage 22 to cross with cable 26 with the other end of cable 27 being looped in semicircular fashion around the collar of lower fitting 13 and fastened adjacent thereto. Suitable compressible cable crimps 28 can be employed to fasten the ends of the looped cables adjacent the collars of fittings 13. As a consequence of this arrangement, actual horizontal movements of the cables are reduced to a minimum, particularly since vertical handle 18 has been centered between the two upper and lower collars 13. This structural arrangement for running the cables in crossing relation allows for a comparatively large vertical movement of the handle 18 with a comparatively smaller horizontal movement of the cables instead of the past larger horizontal cable movement. Further, it permits lever 18 to be as compact as possible and also provides a high beginning mechanical advantage of lever 18 to overcome the initial or static resistance of the collars on fittings 13.

Figure 9:
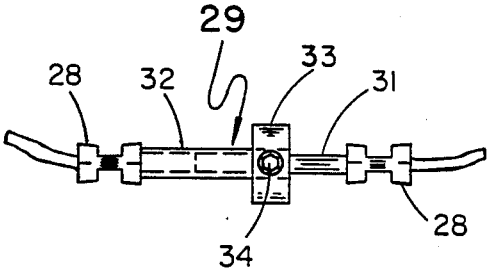

It is to be understood that cable passage 22 in handle 18 can be provided with a suitable lining, such as a brass or plastic tube 5 (not shown in detail) to reduce cable passage friction. Moreover, as can be seen in FIGS. 2, 3, and 9, each cable can be spliced and provided with a novel linear adjusting assembly 29 to adjust cable tension. As can particularly be seen in FIG. 9, the novel linear adjusting assembly 29 is disclosed as including inner and outer telescoping tubes 31 and 32 with the inner tube having a collar member 33 adjustably positioned thereon. The adjustable collar member 33 is provided with a set screw 34 to set collar 33 at a preselected position thereon, preventing further telescoping of inner tube 31 with outer tube 32 to provide a longitudinally adjustable telescoping tubular assembly. Each of the spliced ends of the cable passes through the adjusted and set telescoping tubes or longitudinally adjustable tubular assembly in overlapping relation with the other end and is held in position at the opposite end of the tube assembly by a cable crimp 28. Thus, a simple, straightforward, longitudinally adjustable tubular assembly can be provided to allow adjustment of the length and tension of each cable.

Referring to the broken away section of FIG. 3, a level sensing and control valve 36 is shown as associated with the upper fluid conduit 11 to control the amount of fluid entering through conduit 11, which serves as a fluid conduit on bottle 3. This valve, which can be any one of a number of commercial type valves, capable of operating at low fluid flow volumes and low pressure heads is responsive to the pressure head in the comparatively small fluid receptacle or bottle 3 (approximately one gallon) serving to throttle or to even shut off fluid inlet velocity which velocity can be relatively low for certain types of fluid systems. Advantageously, a FILL-PRO ® valve, sold by the FILL-PRO Div. of J. H. Industries, Carlsbad, Calif., can be utilized. It has been found advantageous to mount the level sensing valve 36, which desirably is sensitive to a small amount of head pressure, at the upper fluid conduit 11 return port to bottle 3 since this is the best physical configuration for comparatively small bottles such as bottle 13 which can be associated with smaller volume fluid systems having low fluid velocities. The lower conduit 12 of this configuration serves as the outlet conduit for bottle 3, which bottle 3 is arranged to be mounted to the fluid system a pre-selected distance above the pump of the fluid system with which it is associated, this distance being dependent upon a positive pressure requirement at the inlet of pump 2.

In fluid systems having a comparatively large fluid volume and having higher fluid velocities, it has been found desirable to incorporate many of the abovedescribed features of the present invention into a comparatively larger fluid receptacle or bottle with further modifications thereto. Such a larger fluid receptacle or bottle can be seen in FIGS. 5 through 8 of the drawings. Fluid receptacle or bottle 37, which also can be formed from any one of a number of suitable fluid handling materials, such as reinforced plastic, and which also can be shaped in any one of a number of preselected forms, is here shown as a comparatively broader but still rectangular type bottle, similar to what often is referred to in the art as a "Jerry Can." Such a bottle has a fluid capacity of approximately two and one half gallons and, like bottle 3, includes opposed side walls, opposed front and rear walls, a top wall having a carry handle 38 and a fluid supply inlet conduit 39. Upper and lower spaced fluid conduits 41 and 42, respectively, are mounted on the front wall. These fluid conduits 41 and 42 are of evase or inwardly tapered shape from a cylindrical location adjacent their outer portion to the front wall connection. The conduits are sized to have larger dimensions to accommodate larger fluid volumes as are the female or socket fittings 43 with their respective slidable collars mounted thereon. In mechanical structure and operation, the fittings 43 are similar to aforedescribed female fittings 13 and advantageously also are of the Hansen type, only of a larger size to handle greater fluid volume. Like the collars on fittings 13, the collars of fittings 43 are actuated by a similarly connected cable arrangement which includes the pair of cables 46 and 47, each looped around bottle 37 and connected to an upper and lower collar of fittings 43 in an arrangement similar to that for abovedescribed cables 26 and 27, cables 46 and 47 using cable crimps 28, splices and longitudinally adjustable telescoping tubular assemblies 29 in a similar fashion to cables 26 and 27.

Figure 5:
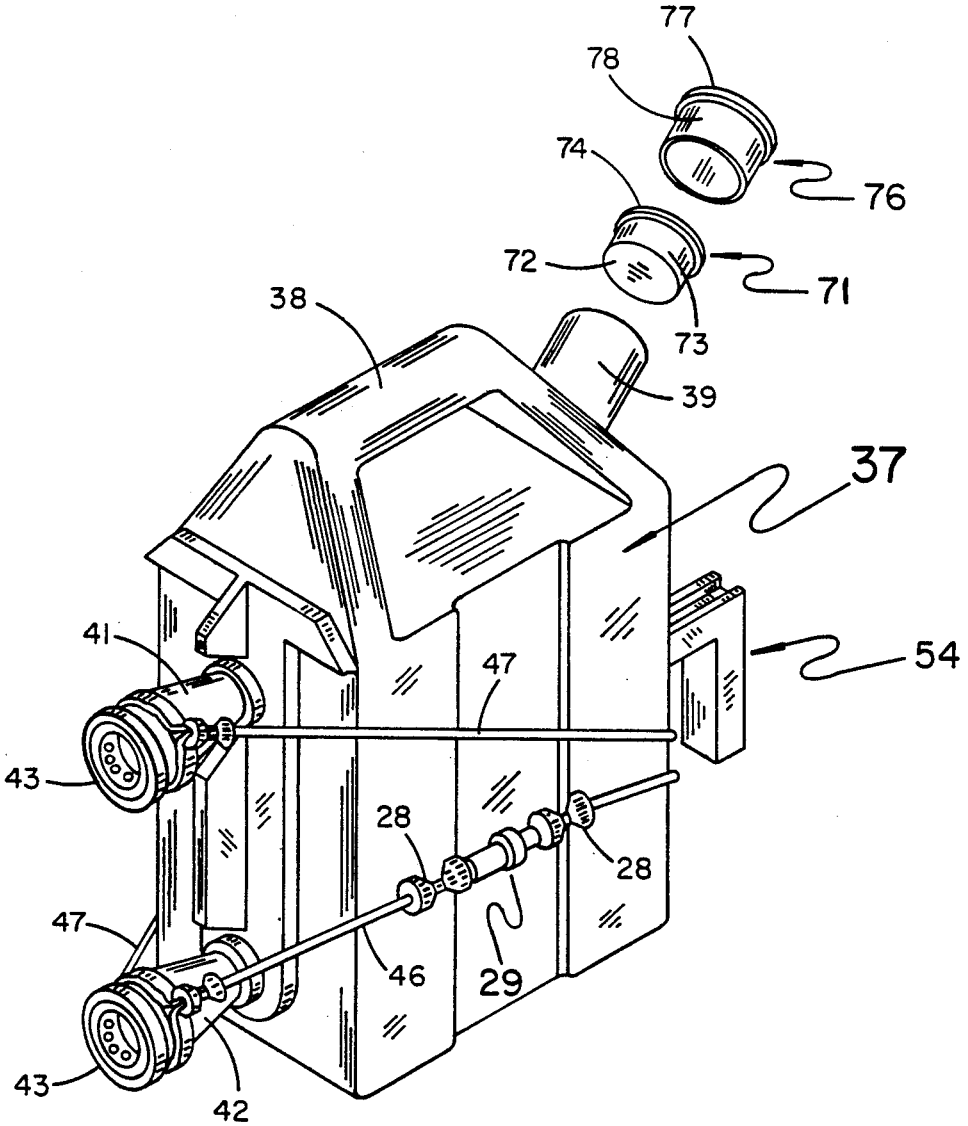
FIG. 5 is an enlarged isometric view of a second or modified embodiment of the novel fluid reservoir of the present invention in the form of a fluid receptacle or bottle particularly adapted for use with a fluid system having a comparatively large fluid volume.
Figure 6:
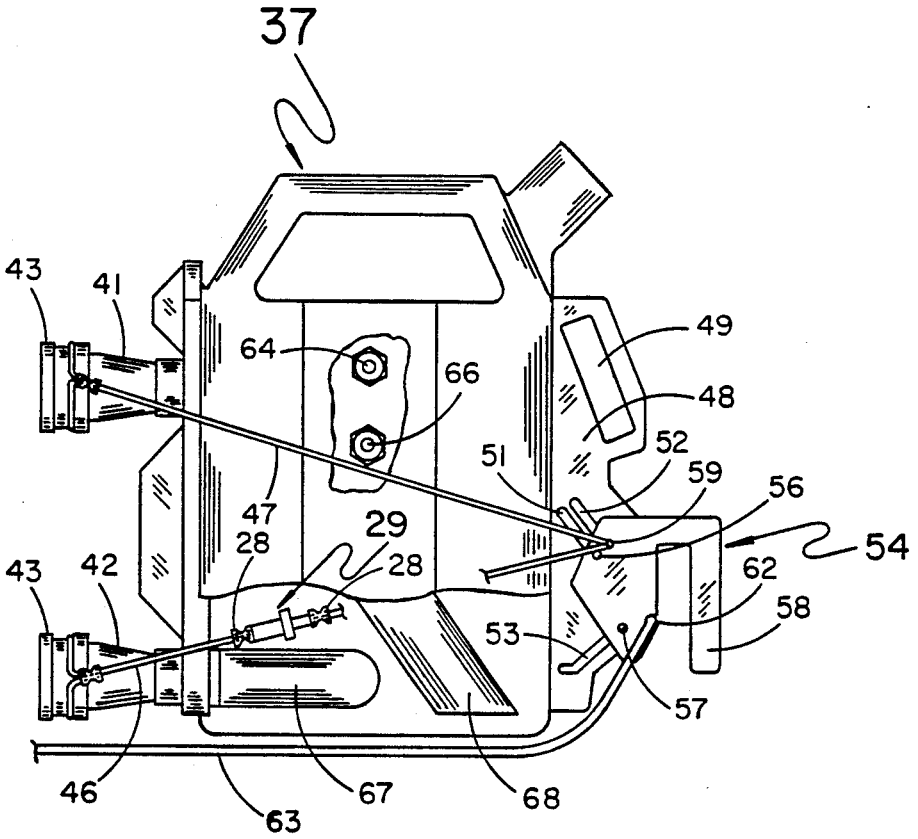
FIG. 6 is a side view of the modified fluid receptacle or bottle of FIG. 5, partially broken away to disclose the outer extremities of the level sensing devices projecting through the opposite side wall of the modified bottle, a fluid diffuser or dampener connected to the lower quick connect-conduit assembly; and the lower portion of a siphon tube connected to the upper quick connect-conduit assembly.
Figure 8:
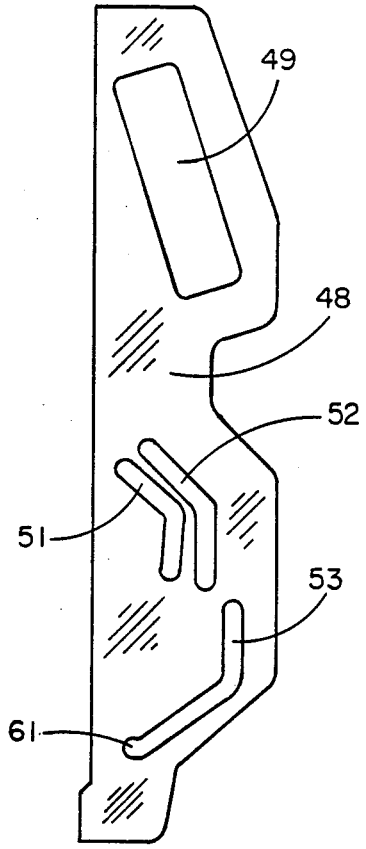
FIG. 8 is an enlarged, side view of the rib member extending from the wall of the fluid receptacle or bottle of FIG. 6 opposite to that wall on which quick connect fittings are mounted on spaced inlet and outlet conduits of the bottle, disclosing the novel slot arrangement cooperative with the bifurcated handle pivotally and longitudinally mounted on the rib member; and, FIG. 9 is an enlarged view of a tensioning device associated with each of the cables which connect the quick connect fittings through a moveable lever on a wall opposite the fittings.

Referring to FIGS. 5, 6, and 8 of the drawings, it can be seen that the handle assembly for fluid receptacle or bottle 37 is a modification of the above described handle assembly disclosed in association with fluid receptacle or bottle 3. As can be seen in FIGS. 6 and 8, only a single longitudinally extending rib 48 is fixed to and extends from the rear wall of bottle 37. Referring particularly to FIG. 8 which discloses details of rib 48, it can be seen that the upper portion of rib 48 is provided with a handgrip slot 49 and that the lower portion is provided with two substantially parallel and spaced angular upper slots 51 and 52 and with a lower, slightly longer and mirror image slot 53. The inner upper slot 51 and the lower, longer, mirror image slot 53 serve as guide slots for bifurcated operating handle 54 (FIG. 6), the bifurcations of which handle 54 straddle the lower portion of rib 48 and which have cross-pins 56 and 57 engaging respectively in slots 51 and 53 for pivotal movement of the handle 54 about the upper and lower guide slots 51 and 53. It is to be noted that handle 54 is provided with a finger grip arm 58 to allow manual pivotal movement of handle 54 about the path determined by guide slots 51 and 53. The outer upper slot 52 in rib 48 serves as a cable passage slot and bifurcated handle 54 is provided with aligned cable passages 59 in the bifurcated sides thereof, passages 59 being positioned to be in pivotal alignment with the outer upper cable passage slot 52, serving to accommodate pivotal movement of cables 46 and 47 which pass through the cable passage 59 and aligned slot 52. It is to be noted in FIGS. 6 and 8 that the upper portions of upper slots 51 and 52 each slope downwardly and outwardly at an angle of approximately forty-five (45) degrees from the vertical with the remaining lower portion of such slots 51 and 52 extending vertically downward therefrom with the middle of the angled upper portions of these two parallel slots 51 and 52 falling in a horizontal plane extending substantially halfway or intermediate between upper fluid conduit 41 and lower fluid conduit 42 mounted on the front wall of bottle 37. It also is to be noted (FIG. 8) that mirror image guide slot 53 has its upper portion extending vertically downward with its lower portion sloping downwardly and inwardly at a corresponding mirror image angle to the sloping upper portions of the upper slots to permit pivotal movement of handle 54. The slope of these slots serves to provide a predetermined caming action of the cables 46 and 47 intersecting at and passing through aligned cable passages 59 and aligned slot 52. This caming action functions on cables 46 and 47 in a similar manner to the aforedescribed caming action on cables 26 and 27 created by the sloping side edges adjacent the rear wall of bottle 3. Further, in a manner similar to the resting indentation 24 on slot 21 of handle 18 (FIG. 4), guide slot 53 includes a resting portion 61 extending horizontally inward at the lower portion thereof to allow the pivoted handle 54 to be held in a rested lower position. In this regard, it is to be noted in FIG. 6 that the bifurcated portion of the pivotal handle 54 is provided with outside cable notches 62 positioned opposite the lower portion of handle 58. These cable notches 62 serve to receive the middle portion of a loop cable 63 which advantageously can be made from Teflon covered stainless steel to enhance cable disengagement. The opposite ends of this loop cable 63 are fastened to the fluid system as indicated schematically at 65 (FIG. 1). With the loop cable 63 engaged in cable notches 62, when handle 54 is pivoted in an upward direction prior to the commencement of an operating mode, fluid receptacle or bottle 37 is drawn inwardly toward the fluid system with which bottle 37 is to be associated and handle 54 is positioned for a downward stroke with commencement of an operating mode and concomitant horizontal movement of cables 46 and 47 and slidable collars on fittings 43 mounted on upper and lower conduits 41 and 42 at the front wall of bottle 37. Like cables 26 and 27, the caming action of the sloped cable guided slots functions in a similar manner to the caming action of cables 26 and 27 on bottle 3 with the highest mechanical advantage occurring at the commencement of the downward stroke.

In effect, both pairs of cables 26 and 27 and cables 46 and 47 have an elliptical function as a consequence of each extending around its respective fluid reservoir and being fastened at opposite ends at locations spaced from each other in substantially the same initial or starting vertical plane through which the collars of the fittings are located, each cable of each set forming an ellipse-like pattern around its associated fluid reservoir. A comparatively large vertical movement of each handle actuates only a small movement of the cable pairs in a horizontal direction. The comparatively small horizontal cable movement is optimized by centering the handle's vertical movements in either direction from a horizontal plane extending between the upper and lower connecting points for each cable—as described above for both embodiments of the fluid reservoirs 3 and 37. This optimizing of horizontal cable movement provides for a high mechanical advantage with the highest mechanical advantage being at the initial horizontal movement of the collars to overcome the static resistance thereof. At the same time, a minimum of horizontal space is required to thus provide a compact handle arrangement. It is to be noted that the overall mechanical advantage of the handle can be calculated roughly by dividing the overall vertical distance of the lever movement from commencement of horizontal movement of the collars to the end of such horizontal movement by the overall distance of horizontal movement of such collars. By caming each cable as above described in a direction away from the determining vertical planes in which the front ends of the collars initially rest, the mechanical advantage of the lever decreases as the horizontal component of this direction increases. The elliptical function of the cables, as above discussed, can be mathematically demonstrated as enhancing the desired higher mechanical advantage at the outset of that portion of the lever stroke which serves to initially move the collars, overcoming the initial static momentum of the collars.

Figure 7:
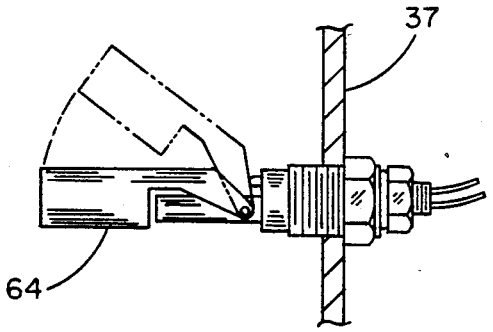
FIG. 7 is a side view of one of the level sensing devices, the ends of which are disclosed in FIG. 6.

Referring to FIGS. 6 and 7, fluid control structure for controlling fluid flow through bottle 37 is shown. As can be seen in the broken away portion of bottle 37, the ends of a pair of side mounted upper and lower level switches 64 and 66, respectively are disclosed with a side view of switch 64 being disclosed in FIG. 7. These level sensing switches can be identical and can be selected from any one of a number of commercially available switches. Advantageously, commercial switches available from Imo Delaval, Cincinnati, Ohio, can be utilized. These switches, which are used to determine the upper and lower fluid levels of bottle 37, are connected electrically to solenoid valves in the associated fluid system (FIG. 1). In the larger bottle 37, it has been found desirable that the lower fluid conduit 42 serves as the fluid inlet and the upper fluid conduit serves as the fluid outlet of bottle 37. This accommodates the high fluid velocity of larger fluid systems, a cylindrical porous filter 67 being associated with lower fluid conduit inlet 42 and disposed within bottle 37 to reduce fluid velocity and concomitant turbulence at the inlet. Any one of a number of types of commercially available filters and dampeners can be utilized. Advantageously, a tough, high density, polyethylene porous tube sold as a pneumatic air silencer by Porex Technologies, Inc., Fairburn, Ga., has been found to be ideal for this purpose. A siphon tube 68 having its open end extending into the bottom of bottle 37 and its upper end connected to the upper outlet conduit 41 serves to complete the circulation path within bottle 37. In one form of operation, as fluid, such as water, rises in bottle 37 to a desired level, the lower level switch 66 reacts to close a solenoid valve in the associated fluid system shutting off fluid flow in the lower inlet conduit 42. This can be controlled for valve closure for a preselected period of time with the fluid level decreasing in bottle 37 and with the solenoid controlled by lower level switch 66 opening the valve to again allow fluid introduction through lower inlet conduit 42. The upper level switch 64 which also can be connected to one or several solenoid responsive valves in the associated fluid system, simply serves as a redundant protective device to prevent overflow in bottle 37, by shutting off the fluid flow system to which the bottle is connected.

It is to be noted that the fluid supply inlet opening 9 of bottle 3 and the fluid inlet opening 39 of bottle 37, can each be provided with a novel closure in the form of a removable cover that includes spaced perforated cover walls extending across the inlet opening to allow ambient air to enter the bottle with which it is associated above upper fluid level therein and to prevent splashing therefrom. Specifically, as shown in FIGS. 2, 3 and 5 of the drawings, such a closure includes an appropriately sized first cup-like member 71 that extends nestingly into the fluid opening of conduit 9 with its bottom cover wall 72 being perforated at 73 to allow air passage therethrough. Cup-like member 71 is provided with a rim 74 that supportingly rests along the top of supply inlet 9. A second appropriately sized cup-like member 76 nests over the fluid opening with its bottom cover wall 77 being perforated at 78 and rests on top of opening 9, spaced from bottom cover wall 72 of cup-like member 71. The perforations 73 and 78 allow ambient air to enter the bottle, and the spaced cover walls 72 and 77 prevent splashing from the bottle.

From the above, it can be seen that a unique fluid reservoir structure for a fluid system is provided which can be quickly engaged and disengaged with respect to a fluid system by a single operator with a minimum of operating steps allowing both simultaneous support and engagement operation by such single operator.

The invention claimed is a follows:

I claim:

1. A fluid reservoir structure for supplying treating fluid to be circulated through a fluid system, the fluid system including quick connect fittings and having a fluid pump associated therewith to receive and circulate treating fluid from said fluid reservoir structure through said fluid system and fluid reservoir structure during a circulating mode comprising:

fluid receptacle means adapted to receive and store treating fluid from a preselected supply source to be circulated through said fluid system and said fluid receptacle means when said fluid receptacle means is connected to said fluid system;

spaced fluid inlet and outlet conduits mounted on a wall of said fluid receptacle means;

adjustable quick connect fittings on said spaced fluid inlet and outlet conduits on said fluid receptacle means to matingly engage with said quick connect fittings in said fluid system during a fluid circulating mode; and, actuating means to remotely actuate said adjustable quick connect fittings on said spaced conduits for engagement with said quick connect fittings of said fluid system during a fluid circulating mode.

2. The fluid reservoir structure of claim 1, and valve means to control circulating fluid flow through said fluid receptacle means during a fluid circulating mode.

3. The fluid reservoir structure of claim 1, said means to remotely actuate said adjustable quick connect fittings on said fluid inlet and outlet conduits of said fluid receptacle means including means to actuate said adjustable quick connect fittings simultaneously.

4. The fluid reservoir structure of claim 1, said fluid receptacle means being in the form of a portable bottle.

5. The fluid reservoir structure of claim 1, said fluid receptacle means being in the form of a portable plastic bottle including a moveable lever associated with said actuating means.

6. The fluid reservoir structure of claim 1, and valve means to control circulating fluid flow in said fluid receptacle means during a circulating mode including shut-off valves disposed in said quick connect fittings to move from closed to open position when said fittings are engagingly coupled with said fittings of said fluid system during a circulating mode.

7. The fluid reservoir structure of claim 1, and means cooperative with said fluid system and said fluid reservoir structure to position said fluid receptacle means with said spaced circulating inlet and outlet conduits in matingly connecting relationship to said spaced quick connect fittings associated with said fluid system.

8. The fluid reservoir structure of claim 1, and means cooperative with said fluid system and said actuating means to sequentially position said spaced recirculating inlet and outlet conduits of said fluid receptacle means in matingly connecting relationship with said spaced quick connect fittings associated with said fluid system and then to remotely actuate said adjustable quick fittings on said spaced couplings of said fluid receptacle.

9. The fluid reservoir structure of claim 1, said actuating means to remotely actuate said spaced quick connect fittings on said fluid receptacle means including a moveable lever mounted on said fluid receptacle means;

linkage means connecting said moveable lever with said spaced quick connect fittings on said conduits on said fluid receptacle means; and caming means mounted on said fluid receptacle means in cooperative relation with said linkage means and said moveable lever to actuate said spaced adjustable quick connect fittings on said fluid circulating conduits of said fluid receptacle means through said linkage means.

10. The fluid reservoir structure of claim 1, and level sensing means cooperative with said fluid receptacle means to control the level of fluid therein.

11. The fluid reservoir structure of claim 1, and means cooperative with said fluid inlet of said fluid receptacle means to reduce the return velocity of fluid in said fluid receptacle means.

12. The fluid reservoir structure of claim 1, and stop means associated with said actuating means to arrest said actuating means at a predetermined end of an actuating stroke.

13. The fluid reservoir structure of claim 1, said fluid receptacle means including a supply inlet opening and a removable cover means including spaced perforated cover walls extending in covering relation across said inlet opening to allow ambient air to enter said fluid receptacle above an upper fluid level therein and to prevent splashing therefrom.

14. The fluid reservoir structure of claim 1, said fluid receptacle means including a supply inlet opening; a first cuplike member nesting in said opening and having a perforated bottom cover wall extending thereacross; and a second cup-like member telescoping over said first cup-like member and having a perforated bottom cover wall extending thereacross in spaced relation from the bottom cover wall of said first cup-like member, the spaced bottom cover walls allowing ambient air to enter said fluid receptacle above the fluid level therein and preventing splashing from the receptacle.

15. The fluid reservoir structure of claim 1, said means to remotely actuate said spaced quick connect fittings on said circulating conduits of said fluid receptacle means including:

a moveable lever mounted on said fluid receptacle means;

linkage means connecting said moveable lever with said spaced quick connect fittings on said conduits of said fluid receptacle means, including a pair of crossed linking members, each fixed to and extending in taught relation from one side of one spaced quick connect fitting on said fluid receptacle means in cooperative crossing relation with said moveable lever to one side of the other spaced quick connect fitting on said fluid receptacle means; and, caming means mounted on said fluid receptacle means in cooperative relation with said linkage means to simultaneously cam said linkage means.

16. The fluid reservoir structure of claim 15, said pair of crossed linking members comprising a pair of flexible cable members having a high modulus of elasticity with each cable being in cooperative relation with said moveable lever by extending through a common passage therein.

17. The fluid reservoir structure of claim 15, said pair of crossed linking members comprising a pair of flexible cable members having a high modulus of elasticity with each cable being in cooperative relation with said moveable lever by extending through a common passage therein, each cable being spliced intermediate its extremities with the spliced ends passing through a longitudinally adjustable telescoping tubular assembly in overlapping relation and fastened at opposite extremities of said longitudinally adjustable telescoping tubular assembly.

18. The fluid reservoir structure of claim 15, said moveable lever mounted on said fluid receptacle means being in the form of a handle longitudinally slidable relative slotted rib means extending from a wall of said fluid receptacle means opposite said wall of said fluid receptacle means on which said spaced fluid inlet and outlet conduits are mounted.

19. The fluid reservoir structure of claim 15, said moveable lever mounted on said fluid receptacle being in the form of a handle pivotally moveable relative slotted rib means extending from a wall of said fluid receptacle means opposite said wall of said fluid receptacle means on which said spaced fluid inlet and outlet conduits are mounted.

20. The fluid reservoir structure of claim 15, said moveable lever mounted on said fluid receptacle means being moveable in a preselected path to have a higher mechanical advantage at the commencement of movement to overcome the initial static resistance of said quick connect fittings on said fluid receptacle means.

21. The fluid reservoir structure of claim 15, said caming means including an inclined ramp on said fluid receptacle means sloping in a direction away from said spaced quick connect fittings on said fluid receptacle means to be in cooperative relation with said linkage means to actuate said spaced quick connect fittings on said circulating conduits through said cross linking members which follow the course of said inclined ramp.

22. The fluid reservoir structure of claim 21, said inclined ramp being in the form of an inclined wall on said fluid receptacle means over which said crossed linking members pass;

said moveable lever being moveable relative said container to actuate said crossed linking members in cooperative crossing relation therewith.

23. The fluid reservoir structure of claim 21, said inclined ramp being in the form of inclined slots in an integral rib extending from a wall of said fluid receptacle means opposite said wall of said fluid receptacle on which said spaced fluid inlet and outlet conduits are mounted.

24. The fluid reservoir structure of claim 21, and notch means cooperative with said moveable lever to hold said lever in arrested position at the end of an actuating stroke.

25. A fluid reservoir structure for supplying treating fluid to be circulated through a fluid system, the fluid system including quick connect fittings and having a fluid pump associated therewith to receive and circulate treating fluid from said fluid reservoir structure through said fluid system and the fluid reservoir structure during a circulating mode comprising:

a portable plastic bottle having a carrying handle and supply inlet at the top wall portion thereof to receive and store treating fluid from a preselected supply source to be circulated through said fluid system and said portable plastic bottle when said portable plastic bottle is connected to said fluid system, said supply inlet including removable spaced perforated cover walls cooperatively mounted over the inlet opening;

spaced upper fluid inlet and lower fluid outlet conduits mounted on and extending externally from one side wall of said bottle;

actuable quick connect fittings mounted on said spaced fluid inlet and outlet conduits of said bottle to engage with said quick connect fittings in said fluid system during a circulating mode, said fittings including check valves to stop the flow of fluid in the conduits on which they are mounted when not in a circulating mode engaged position;

a level sensing member mounted within said portable plastic bottle to said upper fluid inlet to control the level of fluid circulated in said portable plastic bottle during a circulating mode;

said portable plastic bottle having that wall opposite the wall on which said spaced upper fluid inlet and lower fluid outlet conduits are mounted sloping upwardly at a preselected angle in a direction away from said spaced quick connect fittings on said spaced conduits to provide an inclined ramp; and, a moveable slotted lever mounted on said inclined wall of said plastic bottle in the form of a handle longitudinally slidable along the slot thereof relative a pair of longitudinally spaced upper and lower pins extending through the slot of said lever and fixed to a pair of spaced slotted ribs adjacent the slot extremities thereof, said spaced slotted ribs extending integrally from said inclined wall of said plastic bottle to reinforce the same, said moveable lever having a cable passage therethrough and an intermediate arresting notch on the edge thereof adjacent said cable passage to engage with said upper pin and arrest the upward stroke of said lever; a pair of polymer treated cable sets having a high modulus of elasticity, each cable set including a pair of spliced cables, with the splices fastened in end-to-end overlapping relation through a telescoping, longitudinally adjustable tubular assembly to maintain each cable in taught condition, each cable having on extremity fixed to and extending in taught relation from one side of one spaced quick connect fitting on said bottle over said inclined wall through said cable passage in crossing relation with the other cable and again over said inclined wall to one side of the other spaced quick connect fitting so as to provide an ellipse-like configuration to move said quick connect fittings into engageable position simultaneously with a high initial mechanical advantage when said moveable lever is slidably moved upwardly.

26. A fluid reservoir structure for supplying treating fluid to be recirculated through a fluid system, the fluid system including quick connect fittings and a loop cable fixed thereto and having a fluid pump associated therewith to receive and circulate treating fluid from said fluid reservoir structure through said fluid system and fluid reservoir structure during a circulating mode comprising:

a portable plastic bottle having a carrying handle and supply inlet at the top wall portion thereof to receive and store treating fluid from a preselected supply source to be circulated through said fluid system and said portable plastic bottle when said portable plastic bottle is connected to said fluid system;

spaced lower fluid inlet and upper fluid outlet conduits mounted on and extending externally from one side wall of said bottle;

a dampener cooperative with said fluid inlet of said bottle to reduce the return velocity of fluid to the bottle during a circulating mode;

actuable quick connect fittings mounted on said spaced fluid inlet and outlet conduits of said bottle to engage with said quick connect fittings in said fluid system during a circulating mode, said fittings including check valves to stop the flow of fluid in the conduits on which they are mounted when not in a recirculating mode engaging position;

a pair of spaced upper and lower level sensing floats within said portable plastic bottle, the lower of which controls the level of fluid recirculated in said portable plastic bottle during a circulating mode and the upper of which controls the pump function associated with the fluid system;

said portable plastic bottle having an integral rib extending from the wall of said bottle opposite said wall of said plastic bottle on which said spaced fluid inlet and outlet conduits are mounted, said integral rib including an upper pair of spaced coextending angular slots and a spaced lower angular slot extending in substantial mirror image relation to said upper slots, one of which upper slots serves as a first handle pin guide and the other of which serves as a cable passage, said upper slots including an upper section sloping downwardly away from said bottle at a preselected angle so that said slot serves as a cable passage providing an inclined caming ramp for cable members passing therethrough and said lower mirror image slot serves as a second handle pin guide, said lower mirror image slot including an arresting notch at the lower end thereof;

a moveable bifurcated hand lever surrounding said integral rib with a first pin member extending between the bifurcations through one of said upper slots which serves as a handle pin guide and with the bifurcations being provided with opposed cable passage apertures aligned with the other of said upper slots serving as a cable passage slot and with a second pin member extending between the bifurcations through said lower mirror image slot which also serves as a handle pin guide with said second pin member engaging in said arresting notch at the terminus of said second mirror image slot at the end of said actuating stroke, said hand lever further including an external notch on the lower portion thereof to nestingly receive said loop cable fastened to said fluid system; and, a pair of polymer treated cable sets having a high modulus of elasticity, each cable set including a pair of cables fastened in end-to-end relation through a longitudinally adjustable telescoping tubular assembly to be held in taught condition and being fixed to and extending in taught relation from one side of one spaced quick connect fitting on said bottle, through said aligned cable apertures in said loop and said cable passage slot, which slot provides an inclined caming ramp and to one side of the other spaced quick connect fittings to move said quick connect fittings into engaged position simultaneously when said handle is moved longitudinally and pivotally relative said slotted rib member, said spaced recirculating inlet and outlet conduits of said bottle being first positioned in connecting relationship to said spaced quick connect fitting associated with said fluid system through said loop cable on said fluid system nesting with said notch as said handle is pivoted inwardly to operating position.

* * * * *